United States Patent [19]

Hertel

[11] 4,308,685

[45] Jan. 5, 1982

[54] TOP WITH ACTUATOR ROD

[76] Inventor: Reinhard Hertel, Rollbaumsberg 284, D-2864 Hambergen, Fed. Rep. of Germany

[21] Appl. No.: 131,867

[22] Filed: Mar. 19, 1980

Related U.S. Application Data

[63] Continuation of Ser. No. 896,438, Apr. 14, 1978, abandoned.

[30] Foreign Application Priority Data

Apr. 21, 1977 [DE] Fed. Rep. of Germany ..... 2717616

[51] Int. Cl.[3] ..... A63H 1/02

[52] U.S. Cl. ..... 46/66; 46/47; 46/60; 46/67

[58] Field of Search ..... 46/47, 51, 52, 64, 65, 46/67; 273/1 R, 1 G, 1 L, 327; 124/5

[56] References Cited

U.S. PATENT DOCUMENTS

| | | | |
|---|---|---|---|
| 476,825 | 6/1892 | Schwartz | 46/47 |
| 1,267,558 | 5/1918 | Komorous | 46/64 |
| 1,462,870 | 7/1923 | Rogers | 46/64 |
| 3,077,051 | 2/1963 | Quinones | 46/47 X |
| 3,939,601 | 2/1976 | Kernell | 46/47 |
| 4,096,659 | 6/1978 | Keane | 46/47 |

FOREIGN PATENT DOCUMENTS

| | | | |
|---|---|---|---|
| 379907 | 9/1907 | France | 46/47 |

*Primary Examiner*—F. Barry Shay
*Attorney, Agent, or Firm*—Michael J. Striker

[57] ABSTRACT

A toy comprising a hollow member and a rod for operating the hollow member. The hollow member has an opening at one of two ends thereof, a smooth circular boundary edge at said one end at the inside of the opening, a spherical rotationally symmetrical surface on its outside at its other end, the axis of symmetry of said surface being coaxial relative to the upper smooth circular boundary edge. Furthermore the toy has a circular annular guide surface disposed within the hollow member adjacent said other end thereof, said guide surface being coaxial with respect to said axis. The toy might have a flange-like edge portion and vanes which extend radially and which are inclined relative to a plane extending normal to an axis of rotation of the member.

18 Claims, 8 Drawing Figures

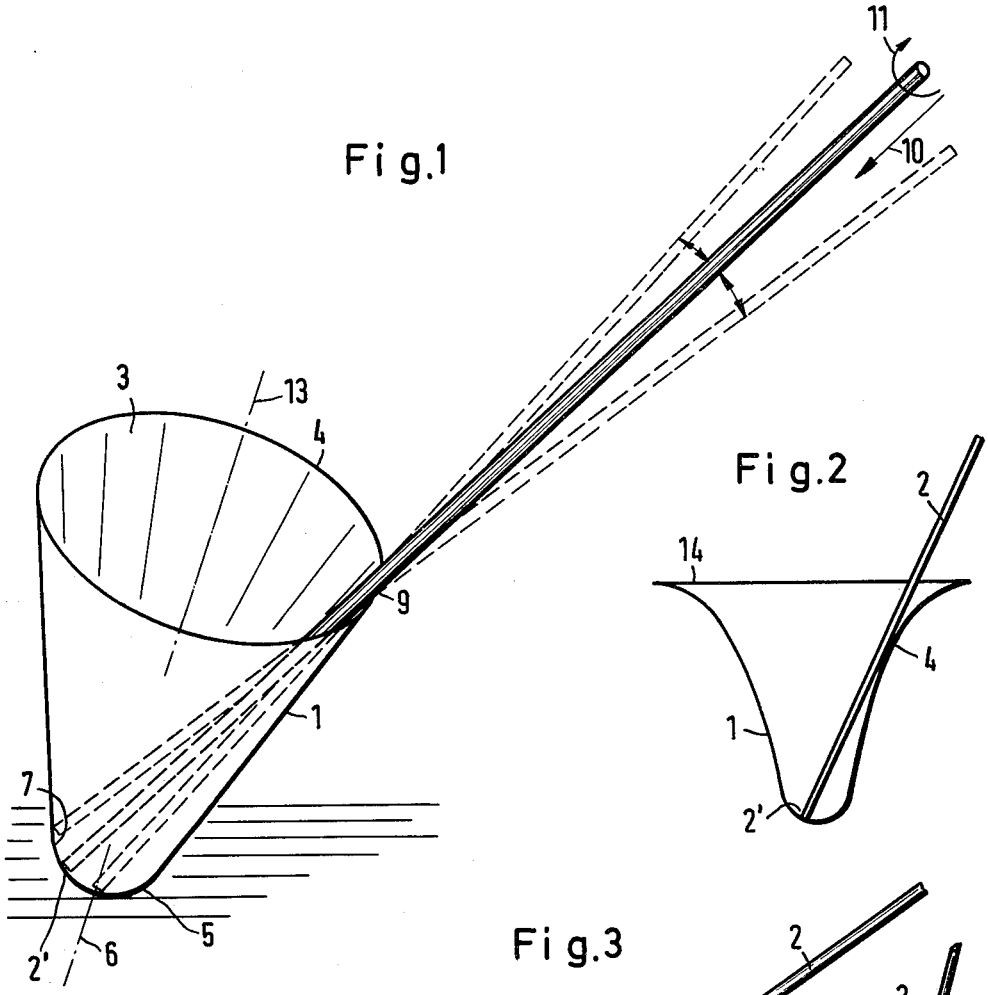
Fig.1
Fig.2
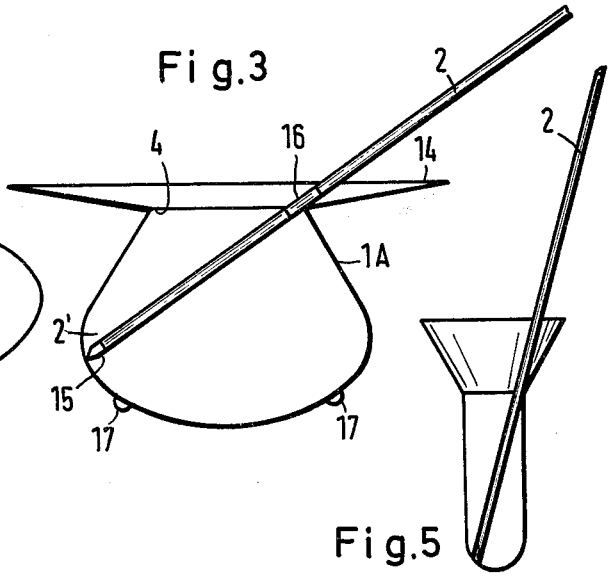
Fig.3
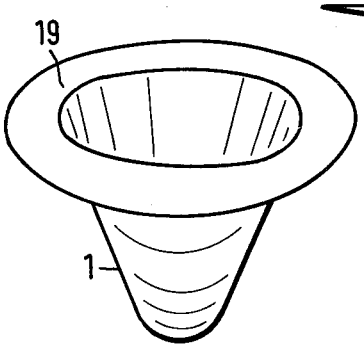
Fig.4
Fig.5

Fig.6
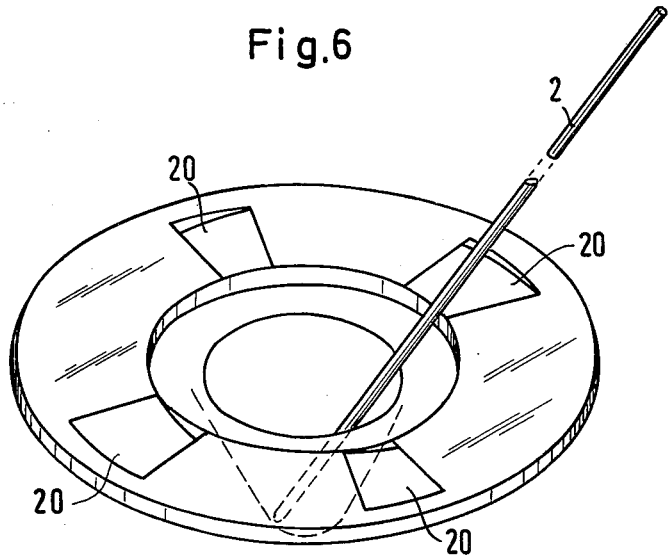
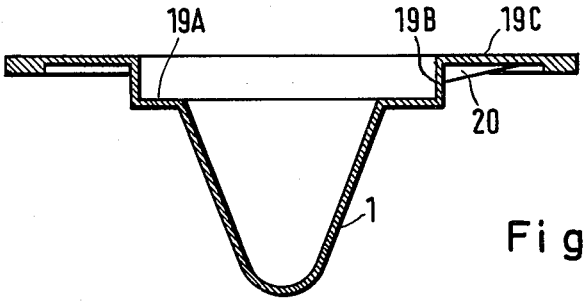
Fig.7
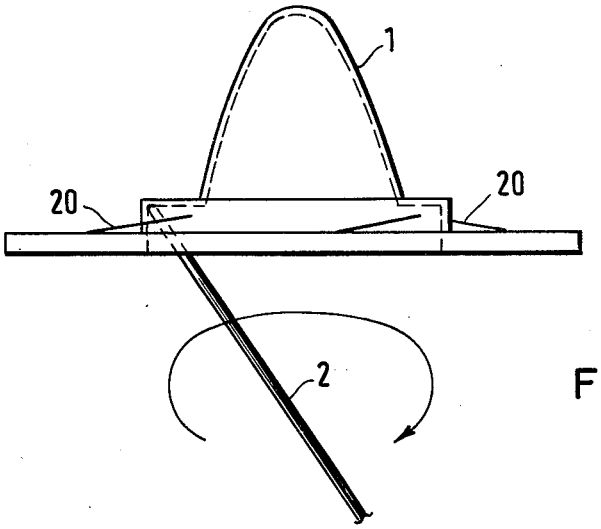
Fig.8

TOP WITH ACTUATOR ROD

This is a continuation, of application Ser. No. 896,438, filed Apr. 14, 1978, now abandoned.

BRIEF SUMMARY OF THE INVENTION

This invention relates to toys.

According to the invention, a toy comprises a hollow member and a rod for operating the hollow member, wherein the hollow member has an opening at one of two ends thereof, a smooth circular boundary edge at said one end at the inside of the opening, a spherical rotationally symmetrical surface on its outside at its other end, the axis of symmetry of said surface being coaxial relative to the upper smooth circular boundary edge, and a circular annular guide surface disposed within the hollow member adjacent said other end thereof, said guide surface being coaxial with respect to said axis.

According to a preferred method of using the toy described in more detail below, the hollow member is caused by operation of the rod to move on a support surface with said one end uppermost. In many cases, it may be desirable for the spherical surface to be substantially in the form of a spherical cup member, and possibly to carry a central tip. This makes it possible for the hollow member to roll laterally along the support surface, when in an inclined position. It may be advantageous for the hollow member to be of resiliently flexible material in a region adjacent said one end thereof. This feature provides that, when the toy is used in a room, furniture is protected from damage, if the hollow member strikes furniture. In addition, this causes the hollow member to spring back, so that, on a limited surface area, similarly to a game of billiards, the hollow member can be played against a cushion.

It may also be advantageous for the spherical surface of the hollow member to be smooth in the centre, and rough in the off-centre spherical region. This measure facilitates starting up the toy, with the hollow member in an inclined position, on a relatively smooth surface, while on the other hand, when the hollow member is running in its preferred operating position, it will run for a long time.

If in an alternative embodiment the hollow member has inwardly projecting raised portions in its interior in a central region intermediate said two ends, then there will be a rattling sound, when the hollow member is rotating, as soon as the rod is pressed sensitively against the raised portions.

In another alternative embodiment, the hollow member may have a rough annular region on its outside in its central region, which provides the advantage that it can be operated or steered or braked with the guide rod against the rough region.

Particular advantages can be achieved with regard to packaging and also manufacturing of the hollow member, if the hollow member is in two parts, namely an annular flange-like part which can be force fitted on to another part. This is particularly advantageous if the annular part is color painted, as interesting colour effects can then be achieved when playing with the toy having differently coloured portions.

In many cases it has been found advantageous for the rod to be at least 30 cm in length, to have a slightly rounded tip at one end thereof intended to be inserted into the hollow member, and to have a smooth surface in a region which is spaced from its said end by approximately the same distance as the opening of the hollow member is spaced from its said other end. This feature reduces friction at the guide surface of the hollow member.

If the rod carries a pointed cap, preferably of metal or plastics material, at its said end, then selecting a cap of the most suitable material one makes it possible to provide the antifriction properties or degree of friction which is the best suited to an intended purpose.

In a preferred embodiment, at its said end the rod carries a preferably spherical rotary member, while on its inside in a region adjacent its said other end, the hollow member has a guide groove whose cross-section is adapted to the rotary member. The rotary member may be comprised of plastic material.

In accordance with another embodiment of the invention, the hollow member is provided with openings which serve to produce sounds when the hollow member rotates. This acoustic effects can additionally be produced while the toy is being used, by varying the speed of rotation thereof.

In order to make it easier for, in particular small children to guide the hollow member, it has been found advantageous for the rod to carry on one side a lateral side arm which projects substantially downwardly in a position of use, and for the position at which the side arm is mounted on the rod to be spaced from an end of the rod intended to be mounted into the hollow member at least as far as the distance by which the edge of the hollow member at its said one end is spaced from the inner surface of the hollow member at its other end.

DESCRIPTION OF THE DRAWING

The invention will now be further described, by way of example, with reference to the accompanying drawings which show embodiments thereof. In the drawings, which are partly in diagrammatic form for simplicity, and which are not to scale, corresponding components are denoted by the same reference numerals. In the drawings:

FIG. 1 is a perspective view of a toy of the invention, in the playing position the toy comprising a hollow member and a rod for operating the hollow member;

FIG. 2 is a view in longitudinal section of an alternative embodiment of the toy shown in FIG. 1;

FIG. 3 is a view in longitudinal section of a toy constituting a further embodiment of the invention, the toy comprising a hollow member with an enlarged bulged portion;

FIG. 4 is a perspective view from above of another form of hollow member, with an upper edge having a flange-like configuration;

FIG. 5 is a view in longitudinal section of another embodiment of the invention;

FIG. 6 shows a perspective view from above of another embodiment of the invention comprising a modification of the toy shown in FIG. 4, this toy being provided with vanes;

FIG. 7 is a view in longitudinal section of the embodiment shown in FIG. 6; and FIG. 8 shows a possible use of the toy shown in FIGS. 6 and 7.

DESCRIPTION OF THE PREFERRED EMBODIMENTS

FIG. 1 shows a toy that comprises a hollow member 1 and an associated rod 2 for operating the hollow member 1. The rod 2 has a lower pointed end 2', preferably in the form of a slightly rounded point. The hollow member 1 has an opening 3 at its upper end and at the inside of the opening 3 has a smooth circular boundary edge 4 which acts as a guide surface during use. At its bottom the hollow member 1 has an outer spherical rotationally symmetrical surface 5 whose axis 6 is coaxial with respect to the upper smooth boundary edge 4. Provided on the inside of the hollow member 1 is a concave annular guide surface 7 which is coaxial relative to the axis 6 and which is preferably spaced by not more than 10% of the height of the hollow member for the outer lower end of the hollow member, that is to say, from the imaginary point at which the axis 6 passes through the spherical surface 5.

The interior of the hollow member is formed substantially as conical surface in the upper region thereof. The included angle of the conical surface is at least 30° and at most 60°, more preferably 35° to 40°.

The hollow member 1 may be of plastic material or metal, and preferably formed as a metal cup.

In order to play a game of skill, the hollow member 1 and the rod 2 are disposed in the position shown in FIG. 1, so that the rod 2 lies against the hollow member at the top circular guide surface 4, as denoted at 9, and the lower pointed end 2' of the rod 2 is pressed on to the inner concave annular guide surface 7 of the hollow member 1. The hollow member 1 is now pushed along a support surface sensitively by means of the rod 2, first slowly and then more rapidly. At the same time, pressure is applied to the rod 2 in the direction indicated by an arrow 10, and the rod is rotated slightly in the direction of an arrow 11. As a result, depending on the respective inclination and pushing force applied, the hollow member 1 is rotated about its own axis 13, which is coaxial with axis 6, at a greater or lesser speed. The respective inclined position determines the respective path of movement of the cup portion on the support surface. The more the inclined position is spaced away from the centering point, the greater is the distance covered by the hollow member 1 across the surface.

The hollow member 1 rolls along on its outer spherical rotationally symmetrical surface 5. When there is sufficient momentum, the rod 2 is removed. Due to the forces which occur upon rotation of the hollow member 1, or the resulting momentum, the hollow member 1 continues to rotate about its axis 13 and, depending on its inclination, describes smaller or larger circular and spiral configurations on the surface. In order to increase the speed of the rotary movements which become slower after a certain time, the rod 2 may be used again in the manner described above, while the hollow member 1 is rotating, so that the speed of rotation of the hollow member can be increased.

The rotary movements of the hollow member become very rapid if the rotating hollow member 1 is guided by means of the guide rod 2 at the smallest possible angle of inclination, with a slightly increased pushing force, as in this case, in contrast to the hollow member being at a larger angle of inclination, the spherical rotational surface 5 is in contact with the support surface, at a rotational distance which becomes smaller towards the central axis 13 of the hollow member 1. Therefore, for the same pushing distance, the hollow member 1 must perform more revolutions when at a small angle of inclination that when at a larger angle of inclination. By skilled application or insertion of the guide rod 2, the rotating hollow member 1 can be disposed as desired at the most widely varying angles of inclination so that the hollow member 1 can consequently describe different patterns on the surface. The hollow member may also be so directed by means of the guide rod 2 that it can remain rotating on one spot.

By skilful guiding of the hollow member 1 by means of the rod 2, full account can be taken of the specific properties or physical laws of a rotating body, that is to say, the rod serving to guide the hollow member can be applied with skill or sensitivity to the respective correct position. In doing this, the hollow member 1 should be guided in such a way that it is never moved into an excessive angle of inclination, so that it always remains possible for the hollow member 1 to be raised and stabilised when the guide rod 2 is removed. It is obvious that the angle of inclination the hollow member will assume also depends on the speed of rotation.

Once the hollow member 1 has been set going, it can be steered in any direction on the support surface, by skilled guidance by means of the guide rod 2, the hollow member always is guided at a slight angle of inclination relative to the support surface so as to be able to roll along on a path on the lower outer spherical cup portion.

By practising, it is also possible to acquire the skill of raising the hollow member as rapidly as possible to high speeds of rotation.

The rod 2 for operating the hollow member 1 may be of resiliently flexible material, for example wood, plastic material or metal, while its diameter and its length are adapted to the size of the hollow member. The length of the rod 2 also depends on whether the game is intended to be played on a table of a limited size, or, in the open air where the supporting surface (i.e. ground) is of unlimited size.

FIG. 1 also shows, in broken lines, two further positions of the rod 2. In these further positions, the lower end 2' lies against different positions in the internal space of the hollow member 1 or on the inner lower annular guide surface 7. The guide surface 7 is in the form of a concave annular surface and permits a stepless transition from a "smaller" to a "larger" circular guiding action and vice-versa, that is, it permits the lower end 2' of the rod 2 to be disposed selectively at a greater or smaller distance from the axis of the annular guide surface 7.

FIG. 2 shows another embodiment in which the inner surface of the hollow member 1 is of a convexly curved configuration. In this case the rod 2 lies against a circular guide line 4. A player can play with this hollow member in the same manner as with the hollow member described above with reference to FIG. 1. A marginal region 14 which projects further outwardly has a similar effect to a flywheel disc and increases the inertia of the rotating hollow member 1.

The hollow member in the form shown in FIG. 3 provides a toy which is of interest from many points of view. In this case the hollow member comprises a lower bulged portion 1A whose largest inside diameter is greater than the diameter of the upper rim or boundary edge 4, and a collar-like outwardly projecting marginal region 14. The lower end 2' of the rod 2 carries a cap 15, which may be a pointed cap, comprising a material with a high degree of wear resistance, preferably metal or plastics material. It may be advantageous for the rod 2 to carry an annular region, preferably in the form of a sleeve 16, made of material having higher wear resistance, in the region in which the rod 2 is in contact with the upper boundary edge 4.

In some cases it is desirable to provide the lower spherical surface of the hollow member with stud-like projections 17. Depending on the configuration and arrangement of the projections 17, and depending on the respective inclined position, noise is produced when the hollow member rotates, and/or the hollow member is caused to move with skipping or dancing motions.

FIG. 4 shows an alternative form of the hollow member shown in FIG. 1, wherein the hollow member 1 carries a removable flange 19 which is force-fitted to the remaining part of the member 1 and which serves as a flywheel ring. The flange 19 is preferably of resilient material, for instance smooth plastic material.

FIG. 5 is a view in longitudinal section of another embodiment of the toy. The hollow member in this case comprising an upper portion which is flared upwardly forming a funnel-like configuration, a central cylindrical portion, and a lower portion of which are preferably in the form of a hollow ball.

In another toy shown in FIGS. 6 to 8, the hollow member 1 has a stepped collar-like flange at its mouth or opening, the flange comprising an inner flange ring 19A, an adjoining hollow-cylindrical part 19B and an outer flange ring 19C. The hollow member 1 is also provided with vanes 20 which are set at an angle. These vanes provide that when the toy is pushed over the support surface, if it is rotating sufficiently rapidly and the rod 2 is suddenly removed, the toy will lift from the support surface.

If, as shown in FIG. 8, the hollow member 1 is placed on the rod 2, the hollow member 1 can then be used as a flying member, in a similar manner to a "Chinese disc". It can also be used as a throwing device. In this case, the hollow member 1 is started up by rotary movement of the rod 2, with the rod bearing against the inner surface of the hollow-cylindrical part 19B. When the hollow member 1 has acquired sufficient impetus, the rod 2 is moved abruptly to the centre, so that the toy rotates on the rod which is kept substantially still.

The embodiments of the invention described above with reference to the accompanying drawings may be modified in a variety of ways within the scope of the invention. For instance, they may incorporate any one or more of the optional features mentioned in the preamble hereto, for instance the central tip of the spherical surface and so forth. Further, the lower region of the inside of the hollow member may be formed substantially as a rotationally symmetrical smooth hollow surface, preferably as the inside surface of a core. The upper end of the rod may be in the form of a sleeve suitable for insertion of an extension rod. The rod may have one or more annular rough regions. The hollow member may carry a colour design on its inside and/or outside. The spherical surface of the hollow member may have a small flattened portion in a central region thereof.

A toy embodying the invention is attractive particularly because it does not set any limits on the imagination of a player of a game employing the toy, offers the player more and more possibilities, depending on his particular ability, and affords the attraction that the player can again and again venture to go to the limits of what is possible for him at the time.

Many possible modifications will become apparent from the foregoing without departing from the spirit of the present invention. However, the foregoing disclosure is presented in an illustrative sense rather than a limiting sense and the appended claims are relied upon to define the scope of the present invention.

What I claim is:

1. A top, comprising a hollow body having a longitudinal axis, an outer surface of revolution formed about said axis, an upper open end, an opposite closed end, said outer surface having a part-spherical convex outer surface portion coaxial with said axis and adapted to frictionally engage a supporting surface on which the top is to be spun, and an inner surface having at said closed end a concave surface portion ccaxial with said axis and a circular surface upwardly spaced therefrom adjacent said open end and also coaxial with said axis; and an actuator rod adapted to frictionally engage with one end thereof said inner surface portion and with a portion upwardly spaced from said end, said circular surface in such a manner that the axis of the top is inclined at an angle of less than 90° to the supporting surface and so that said convex outer part-spherical portion will engage said supporting surface at a point outside said axis, whereby when said hollow body is pushed along said supporting surface by said actuator rod while maintaining said axis inclined at said angle by the frictional contact of the rod with said surface portion and with said circular surface, the top will be rotated about its axis due to frictional contact with said supporting surface along a path transverse to said axis and passing through said point.

2. A top as defined in claim 1, and further comprising means at least on said upper end portion for developing sounds when said body rotates about said axis.

3. A top as defined in claim 2, wherein said sound developing means further include projections on said outer surface portion of said body adapted to strike the supporting surface when the body rotates on the latter.

4. A top as defined in claim 1, wherein said hollow body has upwardly spaced from said part-spherical closed end a portion of frustoconical cross-section tapering toward said closed end.

5. A top as defined in claim 4, wherein the included angle of said frustoconical portion is between 30° and 60°.

6. A top as defined in claim 4, wherein the included angle of said frustoconical portion is between 35° and 40°.

7. A top as defined in claim 1, wherein said body is of synthetic plastic material.

8. A top as defined in claim 1, wherein said body is of metal.

9. A top as defined in claim 1, wherein said circular guide surface is located at said open end of said body.

10. A top as defined in claim 1, wherein said circular guide surface is downwardly spaced from said open end and wherein said hollow body flares outwardly from said guide surface.

11. A top as defined in claim 1, wherein said circular guide surface is downwardly spaced from said open end and has between said circular guide surface and said open end a frustoconical portion tapering towards said guide surface.

12. A top as defined in claim 1, and including a radially outwardly projecting annular flange connected to said body about the open end thereof.

13. A top as defined in claim 12, and including means provided on said flange for lifting said top from said supporting surface when said top is rotated at high speed and said actuating rod is removed.

14. A top as defined in claim 13, wherein said flange is provided with a plurality of circumferentially spaced openings therethrough and wherein said lifting means comprise a plurality of vanes each connected at one end to said flange and extending from said connected end inclined at an angle to said flange into the region of the respective opening.

15. A top as defined in claim 1, wherein said outer part-spherical surface portion is smooth at the center and is rough in the off-center region.

16. A top as defined in claim 1, and including a cap of wear-resistant material at said one end of said actuator rod.

17. A top as defined in claim 1, wherein said actuator rod includes a portion of wear-resistant material arranged for engagement with said circular surface.

18. A top as defined in claim 17, wherein said portion of wear-resistant material is a sleeve surrounding the portion of the rod engaging said circular surface.

* * * * *